US009221146B2

(12) United States Patent
Hildebrandt et al.

(10) Patent No.: US 9,221,146 B2
(45) Date of Patent: Dec. 29, 2015

(54) BELT FINISHING DEVICE, BELT FINISHING SYSTEM AND METHOD FOR PRODUCING A BELT FINISHING DEVICE

(71) Applicant: Supfina Grieshaber GmbH & Co. KG, Wolfach (DE)

(72) Inventors: Oliver Hildebrandt, Hornberg (DE); Simon Wolber, Schiltach (DE)

(73) Assignee: Supfina Grieshaber GmbH & Co. KG, Wolfach (DE)

( * ) Notice: Subject to any disclaimer, the term of this patent is extended or adjusted under 35 U.S.C. 154(b) by 0 days.

(21) Appl. No.: 14/039,832

(22) Filed: Sep. 27, 2013

(65) Prior Publication Data

US 2014/0094099 A1 Apr. 3, 2014

(30) Foreign Application Priority Data

Oct. 1, 2012 (EP) ..... 12186775

(51) Int. Cl.

| | |
|---|---|
| ***B24B 21/20*** | (2006.01) |
| ***B24B 21/08*** | (2006.01) |
| ***B24B 21/02*** | (2006.01) |
| ***B24B 21/06*** | (2006.01) |
| ***B24B 35/00*** | (2006.01) |

(52) U.S. Cl.

CPC ..... *B24B 21/20* (2013.01); *B24B 21/02* (2013.01); *B24B 21/06* (2013.01); *B24B 21/08* (2013.01); *B24B 35/00* (2013.01); *Y10T 29/49* (2015.01)

(58) Field of Classification Search

CPC ..... B24B 21/02; B24B 21/06; B24B 21/08; B24B 21/20

USPC ..... 451/49, 302, 303, 309, 311

See application file for complete search history.

(56) References Cited

U.S. PATENT DOCUMENTS

| | | | | |
|---|---|---|---|---|
| 1,905,821 | A * | 4/1933 | Dunbar et al. | 451/181 |
| 2,671,993 | A * | 3/1954 | Jones et al. | 451/303 |
| 4,145,846 | A * | 3/1979 | Howland et al. | 451/5 |
| 4,443,977 | A * | 4/1984 | Gaiani | 451/309 |
| 4,682,444 | A * | 7/1987 | Judge et al. | 451/49 |
| 5,531,631 | A * | 7/1996 | Judge | 451/5 |
| 5,695,391 | A * | 12/1997 | Steinwender | 451/168 |
| 6,080,051 | A * | 6/2000 | Weber | 451/303 |
| 6,203,402 | B1 * | 3/2001 | Hildebrandt | 451/8 |
| 6,309,287 | B2 * | 10/2001 | Martin et al. | 451/303 |
| 6,454,638 | B2 * | 9/2002 | Bonachera et al. | 451/303 |
| 6,746,315 | B2 * | 6/2004 | Klukos | 451/50 |
| 7,115,023 | B1 * | 10/2006 | Owczarz | 451/44 |
| 7,413,498 | B2 * | 8/2008 | Omata et al. | 451/5 |
| 8,408,973 | B2 * | 4/2013 | Grabsch et al. | 451/302 |
| 8,517,804 | B2 | 8/2013 | Weigmann et al. | |
| 8,771,037 | B2 * | 7/2014 | Boggs et al. | 451/5 |

FOREIGN PATENT DOCUMENTS

| | | |
|---|---|---|
| DE | 43 18 007 | 12/1994 |
| DE | 103 32 605 | 2/2005 |
| EP | 2 212 058 | 7/2011 |

* cited by examiner

*Primary Examiner* — Timothy V Eley

(74) *Attorney, Agent, or Firm* — Henry M. Feiereisen LLC

(57) ABSTRACT

A belt finishing device includes a finishing belt, two bearing surfaces that are spaced-apart in a running direction of the finishing belt, and a pressing device for pressing the finishing belt against a workpiece surface. The pressing device has a pressure belt that is supported on the two spaced-apart bearing surfaces. At least one of a bearing surface and the pressure belt have a profile that deviates in a width direction of the finishing belt from a straight course.

17 Claims, 17 Drawing Sheets

BELT FINISHING DEVICE, BELT FINISHING SYSTEM AND METHOD FOR PRODUCING A BELT FINISHING DEVICE

CROSS-REFERENCES TO RELATED APPLICATIONS

This application claims the priority of European Patent Application EP 12 186 775.8, filed Oct. 1, 2012, pursuant to 35 U.S.C. 119(a)-(d), the content of which is incorporated herein by reference in its entirety as if fully set forth herein.

BACKGROUND OF THE INVENTION

The present invention relates to a belt finishing device with a pressing mechanism for pressing a finishing belt against a workpiece surface.

The following discussion of related art is provided to assist the reader in understanding the advantages of the invention, and is not to be construed as an admission that this related art is prior art to this invention.

In finish-machining, the workpiece surface to be machined is rotatably driven and relative movement between the workpiece and the finishing belt parallel to the workpiece axis is superimposed on this rotary motion. In this way, the workpiece surface is provided with a cross-cut structure characteristic for the finishing method.

The workpiece surfaces to be machined are in particular bearing surfaces of crankshafts or camshafts. These bearing surfaces must be manufactured with a high dimensional accuracy. In particular, the bearing surfaces of the crankshaft or camshaft should be made so as to ensure, in cooperation with the bearing surfaces of a crankshaft or camshaft housing or with the bearing surfaces of a connecting rod, low-backlash and low-friction bearings with high bearing surface proportions.

It has been observed that the above requirements cannot be optimally met with the conventional belt finishing devices. It would therefore be desirable and advantageous to obviate these prior art shortcomings and to provide an improved belt finishing device that enables the production of workpiece surfaces with high dimensional stability.

SUMMARY OF THE INVENTION

According to one aspect of the present invention, a belt finishing device includes a finishing belt, two bearing surfaces that are spaced-apart in a running direction of the finishing belt, and a pressing device for pressing the finishing belt against a workpiece surface, wherein the pressing device comprises a pressure belt that is supported on the two spaced-apart bearing surfaces, wherein at least one of a bearing surface and the pressure belt have a profile that deviates in a width direction of the finishing belt from a straight course.

The invention is based on the observation that, when using bearing surfaces known in the art, which have a straight profile in the width directions of the finishing belt (for example using cylindrical roller bearings and a pressure belt having a rectangular profile), the pressure belt is subjected to different tensile stress in the widthwise direction of the finishing belt. In a region with a higher tensile stress of the pressure belt, a higher pressing force is applied to a contact region of the finishing belt. In areas of the pressure belt with lower tension, a lower pressing force is applied to finishing belt areas supported on these areas. The different pressing forces cause the workpiece surface to be machined to deviate from a desired nominal contour.

According to the invention, the geometry of the workpiece surface to be machined is now influenced, namely by forming the profile of at least one of the bearing surfaces and/or of the pressure belt different from a linear course. A profile according to the invention deviating from a straight course has a predetermined shape which can not be provided by the surfaces of cylindrical roller bearings with the standard tolerances and by the pressure belts with a rectangular cross-section.

According to an advantageous feature of the present invention, the profile according to the invention of the at least one bearing surface and/or of the pressure belt has at least one profiled section which deviates by at least 10 micrometer, in particular by at least 20 micrometers from a mathematically ideal straight line.

Advantageously, the profile may have a curvature. For example, the profile of the pressure belt may have a curvature. Through contact of the pressure belt having a curved profile with the finishing belt, the finishing belt is also curved commensurately, namely about an axis of curvature extending parallel to a running direction of the finishing belt. In this way, the geometry of the workpiece surface to be finished can be specifically influenced. For example, the curvature of the pressure belt may be designed so that the workpiece surface to be finished attains a nearly perfect cylindrical shape. However, the curvature of the pressure belt may also be designed so as to produce a workpiece surface with a nominal shape deviating from a cylindrical shape. Specifically, convex workpiece surfaces can be produced. However, it is also possible to produce concave workpiece surfaces.

According to another advantageous feature of the present invention, at least one of the bearing surfaces may deviate from a straight course in the width direction of the finishing belt. For example, the profile of at least one of the bearing surfaces may be curved. When for example at least one of the bearing surfaces has a concave curvature, a higher tension is applied to the pressure belt in the outer side areas than in a central region. A finishing belt contacting this pressure belt is subjected to a higher pressing force in the outer side areas than in a central region. In this way, a workpiece surface can be produced which has a convex profile, i.e. which has a larger diameter in a central region than in the outer side regions.

The above-described options (at least one curved bearing surface, a pressure belt having a curved profile) may also be combined.

Within the context of the present invention, a bearing surface for supporting the pressure belt may advantageously be made entirely of the same material in order to define and produce a more dimensionally stable profile that deviates from a straight course.

Similarly, the pressure belt may have a pressing surface cooperating with the finishing belt, which is formed from only a single layer material or pressure belt material. This allows specifying and producing a particularly dimensionally stable profile of a pressure belt deviating from a straight course.

According to another advantageous feature of the present invention, the at least one bearing surface and/or the pressure belt may be continuous so that they completely support the finishing belt across its width. Alternatively, the at least one bearing surface and/or the pressure belt may have at least one discontinuity, so that the finishing belt is subjected to a lower pressing force, when viewed in the width direction, at least in the region of the discontinuity of the bearing surface and/or the pressure belt. The geometry of the workpiece surface can then be intentionally influenced so that less material is removed in a rotation plane of the workpiece surface associated with the discontinuity and/or the pressure belt than in a laterally adjacent region.

The discontinuities may be, for example, pocket-shaped recesses and/or openings of at least one of the bearing surfaces and/or the pressure belt.

For example, at least one bearing surface may advantageously have recesses or grooves extending parallel to the running direction of the finishing belt. The bearing surface may also be formed by several separate bearing bodies, wherein the bearing bodies are arranged with a mutual offset in the width direction of the finishing belt.

According to another advantageous feature of the present invention, the pressure belt may have pocket-shaped recesses, for example in the region of the profile deviating from a straight course, so that a pressing surface facing the finishing belt is interrupted, whereas a back surface of the pressure belt facing away from the finishing belt is closed. Alternatively, the pressure belt may also be perforated, so that the pressure belt is interrupted not only on the front surface of the finishing belt in contact with the back side of the pressure belt, but also in the region of the back side of the finishing belt facing away from the pressure belt.

According to another advantageous feature of the present invention, at least one of the bearing surfaces may be formed by a bearing roller. This allows support of pressure belt over a high wrap angle.

According to another advantageous feature of the invention, the bearing roller may be floatingly mounted. This has the advantage that the course of the pressure belt and thus the course of the finishing belt can be readily adapted to workpiece surfaces having different diameters.

Advantageously, the bearing roller may be supported on a stationary bearing roller support system. This limits the degree of freedom of movement of a bearing roller.

Alternatively, at least one of the bearing surfaces may be formed by a stationary bearing element. Such a bearing element has an immovable bearing surface. This enables support of pressure belt with very low tolerances.

The pressure belt may also be movable relative to the bearing surfaces. However, according to another advantageous feature of the present invention, a fixing device for fixing the pressure belt relative to the bearing surfaces may be provided. This can further improve the dimensional accuracy of the workpiece surface to be produced.

Advantageously, a pressure belt may be provided with a back side facing away from the finishing belt having a profile that deviates from a linear course. However, at least the pressing surface of the pressure belt may have a profile that deviates from a linear course. In particular, only the pressing surface of the pressure belt has a profile that deviates from a linear course.

The pressing forces that can be transferred by the pressure belt to the finishing belt in the width direction of the finishing belt may be more easily controlled when the pressure belt is formed as an endless belt. Such pressure belt has a front active section whose front end interacts with the back side of the finish belt. Such endless belt is deflected in the region of spaced-apart bearing surfaces and transitions into a rear section that is spaced from the finishing belt.

According to another advantageous feature of the present invention, a rear section of the pressure belt may be supported or is supported by a pressure belt-support device. This creates another possibility for influencing the tension of the pressure belt along the width of the finishing belt.

According to another aspect of the invention, a belt finishing system includes an aforedescribed belt finishing device and a workpiece with a workpiece surface to be machined. At least one of the bearing surfaces and/or the pressure belt has at least one discontinuity, wherein the workpiece surface is also discontinuous in the region of a bore and wherein the position of the discontinuity is aligned with the position of the hole in the width direction of the finishing belt. Such belt finishing system is capable of producing crankshafts or camshafts that have a bore, in particular an oil outlet bore in the bearing surface. A plane of rotation associated with such bore experiences lower pressing forces during the finish-machining of the workpiece surface, so that the finishing belt presses with a lower pressing force against the workpiece in the region of the edge of the bore than in the laterally adjacent regions. This can prevent the finishing belt from penetrating too deeply into the bore and thus remove an excessive quantity of material in the region of the edge of the bore. Advantageously, a workpiece section that is already mechanically weakened in the region of the bore is then not further weakened, so that, in spite of such a bore, bearing surfaces having a comparatively high support surface proportion may be produced.

According to yet another aspect of the invention, in a method for manufacturing an aforedescribed belt finishing device, the nominal contour of a finished workpiece surface is determined and additionally at least one of the following method steps is performed:

- at least one of the bearing surfaces or a pressing surface of the pressure belt facing the finishing belt is provided with a profile that is identical to the nominal contour or has a more pronounced contour;
- at least one of the bearing surfaces and a pressing surface of the pressure belt facing the finishing belt is provided with a partial profile, wherein a superposition of the two partial profiles is identical to the nominal contour or has a more pronounced contour;
- nominal contour sections are defined and removal of material from the workpiece deviating from a circular cylindrical shape is determined for each of the nominal contour sections; at least one of the bearing surfaces and/or the pressure belt is provided with at least one discontinuity, wherein the discontinuity is associated with a nominal contour section having less material removed from the workpiece than an adjacent nominal contour section;
- nominal contour sections are defined, and for each of the nominal contour sections deviating from a circular cylindrical shape removal of material from the workpiece is determined; at least one of the bearing surfaces and/or the pressure belt is provided with discontinuities, which are each associated with a corresponding nominal contour section, wherein the discontinuities have different lengths measured in the running direction of the finishing belt, and discontinuities having shorter lengths are associated with nominal contour sections having greater material removal rates and discontinuities having greater lengths are associated with nominal contour sections having lower material removal rates.

According to another advantageous feature of the present invention, the profile and/or the superposition of the two partial profiles may have a more pronounced contour than the nominal contour, and the profile and/or the superposition of the two partial profiles may across an active width of the finishing belt delimit a segment of a circle, with a segment height that is greater by a factor from 1.5 to 25, preferably by a factor from 3 to 15, especially by a factor from 5 to 10, than a segment height of a segment of a circle that is delimited by the nominal contour across the effective width of the finishing belt.

BRIEF DESCRIPTION OF THE DRAWING

Other features and advantages of the present invention will be more readily apparent upon reading the following description of currently preferred exemplified embodiments of the invention with reference to the accompanying drawing, which shows in.

DETAILED DESCRIPTION OF PREFERRED EMBODIMENTS

Figure 1:
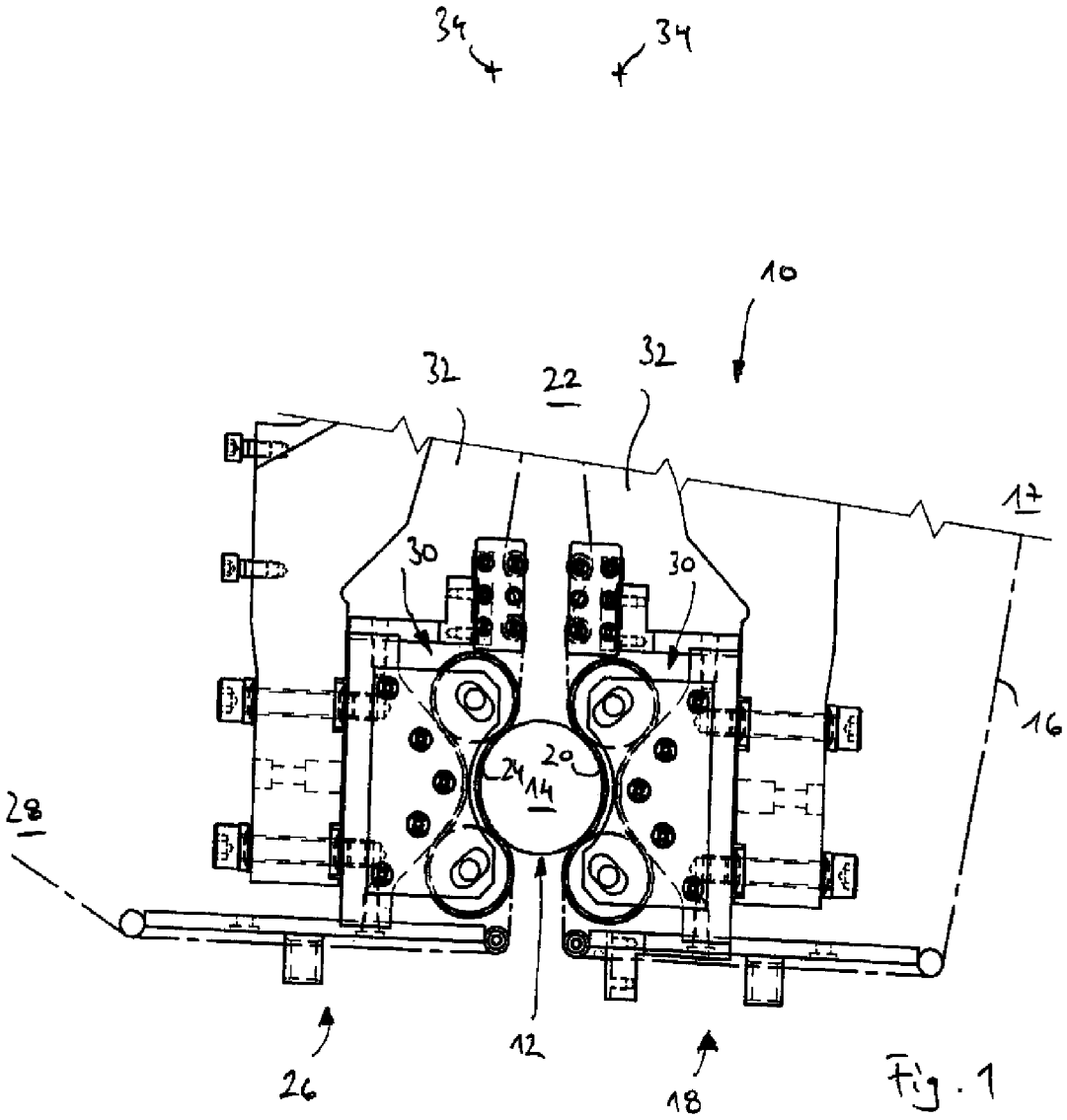
FIG. 1 a side view of an embodiment of a belt finishing device according to the present invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a belt finishing device designated by the reference numeral 10. The belt finishing device is used for finish-machining an in particular rotationally symmetrical workpiece surface 12 of a workpiece 14. The workpiece surface 12 is finish-machined with a finishing belt 16.

A reservoir 17 is, for example, provided for the finishing belt 16. Starting from the reservoir 17, the finishing belt is guided on a guiding/deflection device 18 and deflected, and is in an active region 20 in contact with the workpiece surface 12 across a wrap angle (which is, for example, at least about 10°).

Adjacent to the active region 20 is a region 22, where a spent finishing belt 16 is collected. Alternatively, the finishing belt 16 is deflected in the region 22 and fed to a second effective region 24 opposite the first active region 20. The finishing belt is also in contact with the workpiece surface 12 in the second effective region 24 across a wrap angle (which is, for example, at least about 10°).

A guiding/deflection device 26 is adjacent to the active region 24, from which the finishing belt 16 is fed to a collection region 28.

Pressing devices 30 associated with a respective effective region 20, 24 are provided for applying pressure to the finishing belt 16 in the active regions 20 and/or 24. The pressing devices 30 are each held in respective holders 32, which are preferably pivotable about respective associated pivot axes 34.

The workpiece 14 is driven for rotation about a workpiece axis 36 (see FIG. 2) during finish-machining. An oscillating relative movement parallel to the rotation axis 36 between the finishing belt 16 and the workpiece 14 is superimposed on this rotational movement.

Figure 2:
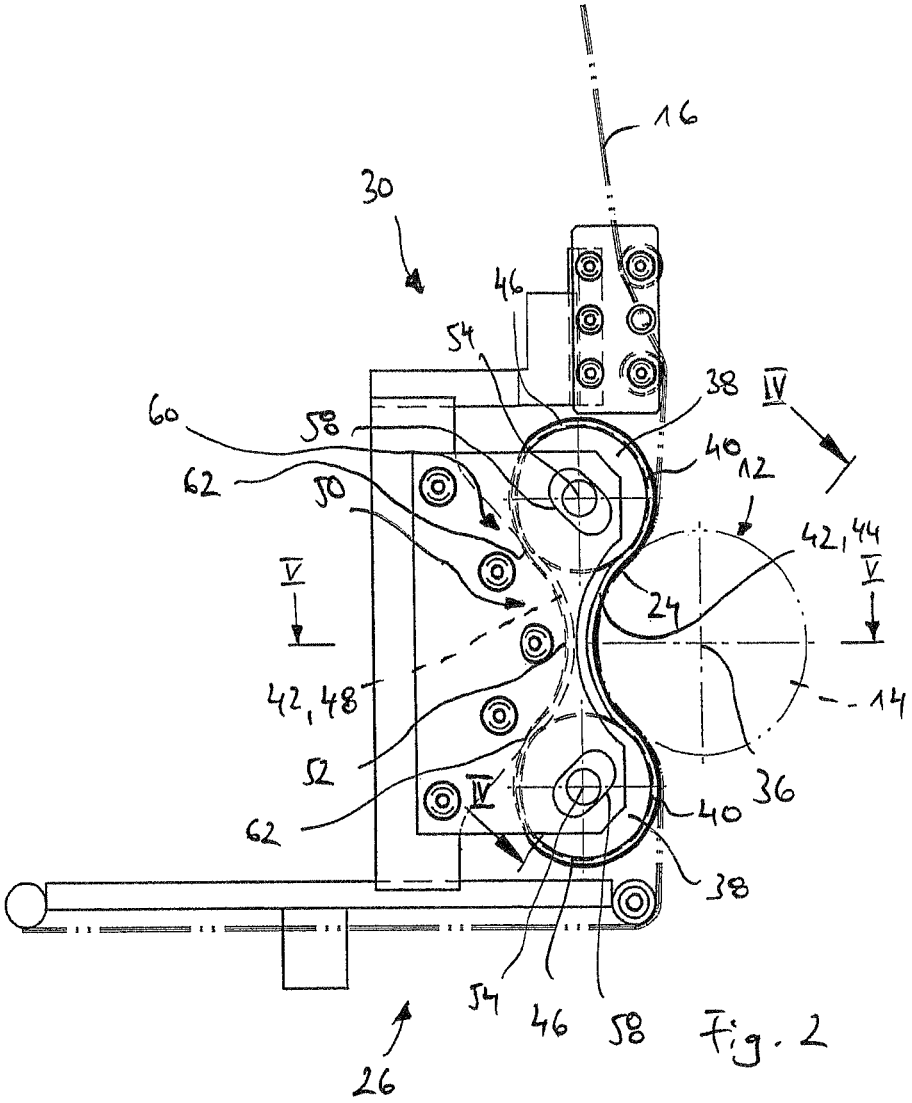
FIG. 2 a side view of a section of the belt finishing device shown in FIG. 1 on an enlarged scale, illustrating a first workpiece having a first diameter.

FIG. 2 shows an enlarged view of a pressing device 30, which has two spaced-apart bearing rollers 38 with radially outwardly oriented surfaces forming bearing surfaces 40 for supporting a pressure belt 42.

The pressure belt 42 is formed as an endless belt. The pressure belt 42 cooperates with the finishing belt 16 by way of a front section 44. Deflection sections 46 which cooperate with the bearing surfaces 40 and transition into a rear section 48 of the pressure belt 42 are located adjacent to the front section 44. The rear section 48 is spaced apart from the front section 44. The rear section 48 is supported in the region of a bearing surface 52 by a pressure belt support device 50. The bearing surface 52 applies a supporting force acting on the rear section 48 of the pressure belt 42 in the direction of the workpiece 14.

The bearing rollers 38 have mutually parallel bearing axles 54. The bearing axles 54 are floatingly supported, for example by bearing elements 56 in the form of slots. The shape and arrangement of the bearing elements 58 (for example, the direction of the slots) is such that the bearing axles 54 are movable in a radial direction in relation to the workpiece axis 36.

Preferably, the bearing rollers 38 are supported by a stationary bearing roller support device 60. The device 60 includes, for example, a bearing surface 62 supporting the bearing rollers 38 through interposition of the pressure belt 42. The devices 50 and 60 may be formed integrally as a single piece. The bearing surfaces 52 and 62 preferably transition into each other continuously (without kinks).

Figure 3:
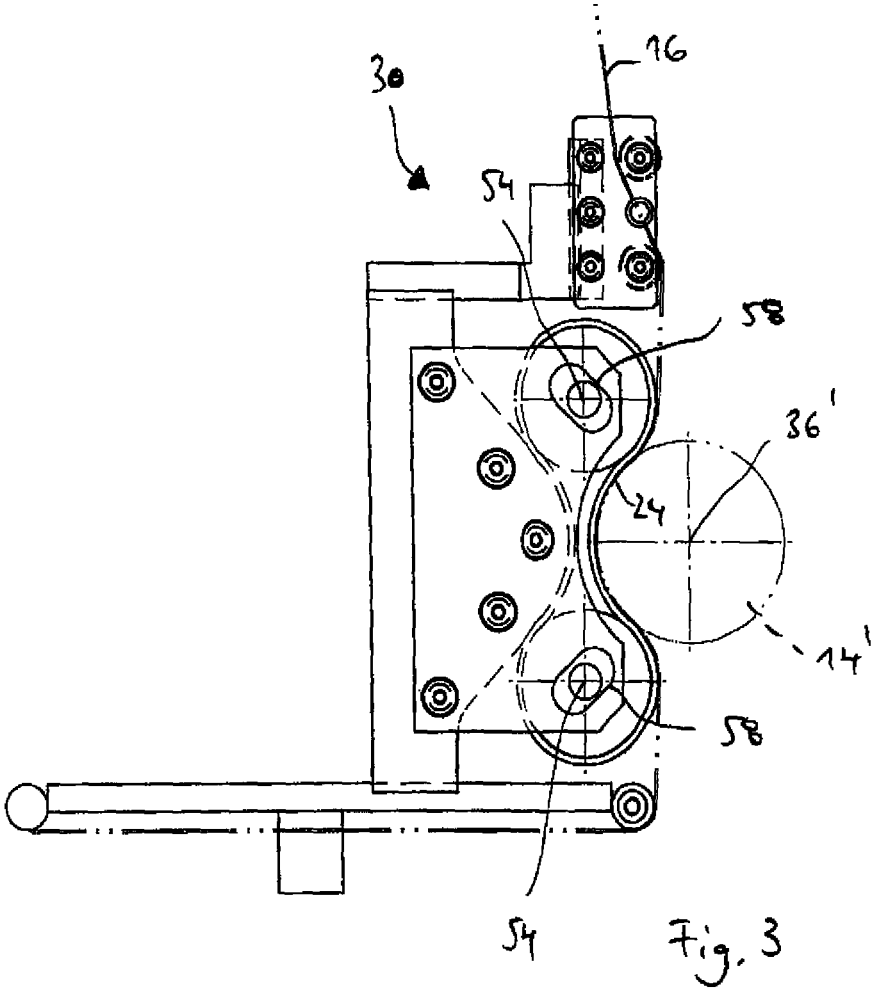
FIG. 3 a view similar to FIG. 2, illustrating a second workpiece with a second diameter that is smaller compared to the first diameter.

The pressing device 30 is suitable for workpieces 14 having different diameters. For example, when instead of the workpiece 14 (see FIG. 2), a workpiece 14' with a smaller diameter (see FIG. 3) is finish-machined, its workpiece axis 36' is displaced toward the finishing belt 16. At the same time, the wrap angle of the effective region 24 increases. In addition, the bearing axles 54 of the bearing rollers 38 shift further in the direction of the workpiece 14'.

Figure 4:
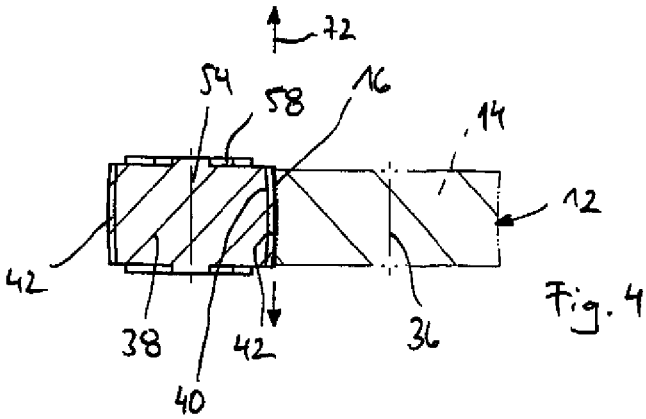
FIG. 4 a view taken along a section line IV-IV shown in FIG. 2.
Figure 5:
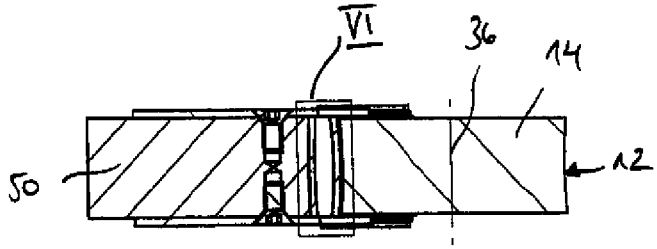
FIG. 5 a view taken along a section line V-V shown in FIG. 2.
Figure 6:
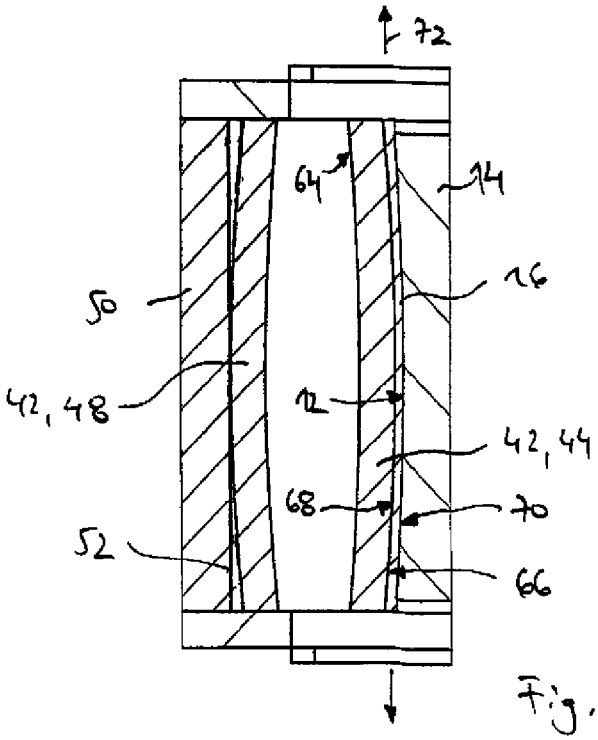
FIG. 6 a detail marked with VI in FIG. 5 on an enlarged scale.

The bearing rollers 38 are rotationally symmetric in relation to the bearing axles 54 and have in profile curved convex bearing surfaces 40 (see FIG. 4). The bearing surface 40 is operative to support a back side 64 (see FIG. 6) of the pressure belt 42.

The pressure belt 42 has a pressing surface 66 facing away from the back side 64, which applies pressing forces to a back side 68 of the finishing belt 16, causing an effective surface 70 of the finishing belt 16 provided with finish material to be pressed against the workpiece surface 12 of the workpiece 14 to be finish-machined The pressure belt 42 has in an undeformed initial state a rectangular cross-section. Thus, the pressing surface 66 in the undeformed state of the pressure belt 42 has a straight course. The pressure belt 42 is elastically deformable and is in the turn sections 46 (see FIG. 2) with its back surface 64 in two-dimensional contact with the bearing surface 40. This deforms the pressure belt 42, so that the pressing surface 66 has a curved profile corresponding to the curvature of the bearing surface 40. The finishing belt 16 in contact with the pressure belt 42 also deforms commensurate with the curvature of the pressing surface 66 of the pressure belt 42, so that the effective region 70 of the finishing belt 16 has a convex curvature, enabling the production of a workpiece surface 12 with a concave curvature. The bearing surfaces 40 and the pressing surface 66 of the pressure belt 42 thus have a curved profile that is different from a straight course in the width direction 72 of the finishing belt 16.

Figure 7:
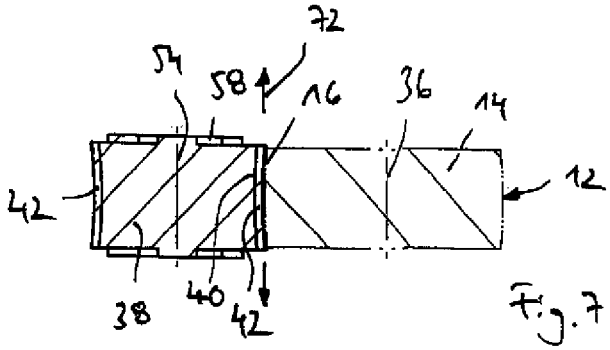
FIG. 7 a view corresponding to FIG. 4 of another embodiment.
Figure 8:
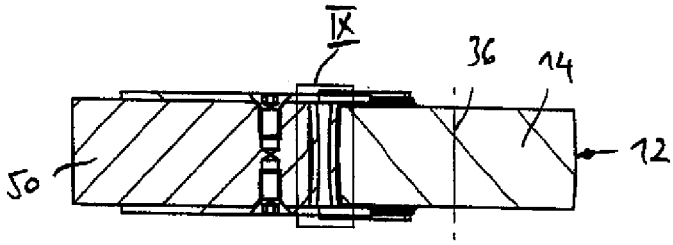
FIG. 8 a view of the embodiment of FIG. 7 corresponding to FIG. 5.
Figure 9:
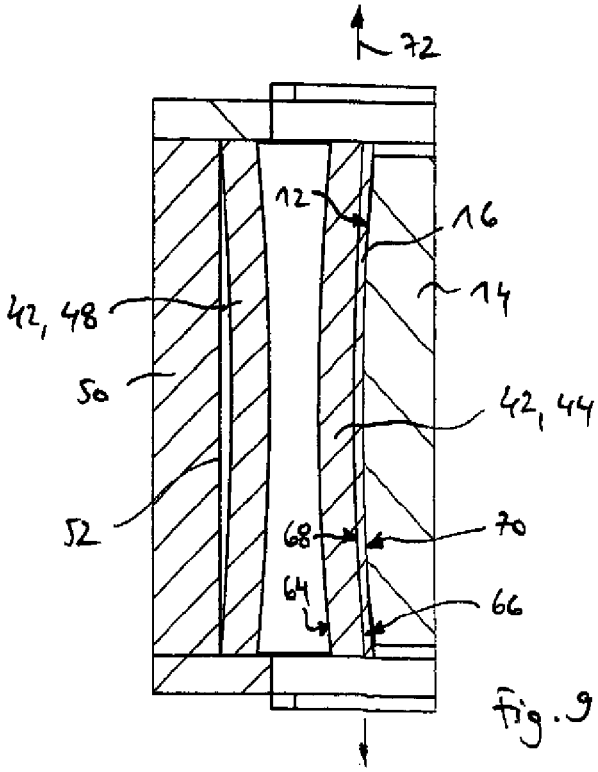
FIG. 9 a view of the embodiment of FIG. 7 corresponding to FIG. 6.

The above description applies likewise for an embodiment illustrated in FIGS. 7-9. However, the bearing surfaces 40 of the bearing rollers 38 in this embodiment have a concave curvature. Interposing the pressure belt 42 creates a concave effective surface 70 of the finishing belt 16, so that a workpiece surface 12 of the workpiece 14 with a convex curvature can be produced.

Preferably, a radius of curvature of a bearing surface 40 with a convex curvature (see FIG. 4) is between approximately 1000 mm and approximately 6000 mm. With a bearing width of about 20 to 25 mm, a suitable chord height (that is a maximum depression relative to a circular cylindrical shape) is from about 0.02 to 0.05 mm.

A radius of curvature of a bearing surface 40 with a concave curvature (see FIG. 7) is preferably between approximately 1000 mm and approximately 6000 mm. With a bearing width of about 20 to 25 mm, a suitable chord height (that is a maximum depression relative to a circular cylindrical shape) is from about 0.02 to 0.05 mm.

Figure 10A:
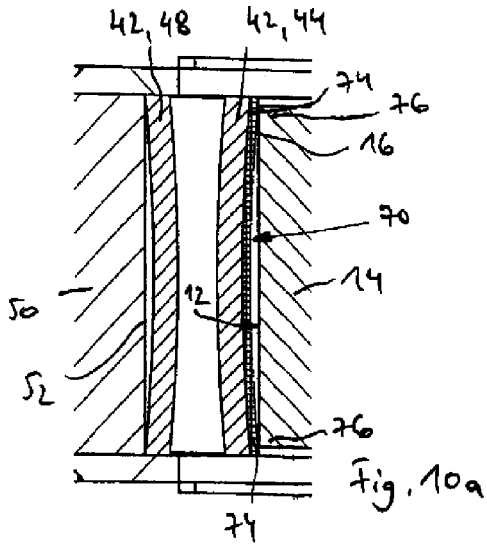
FIGS. 10*a*-10*c* views corresponding to FIG. 9 in consecutive workpiece machining phases.
Figure 10B:
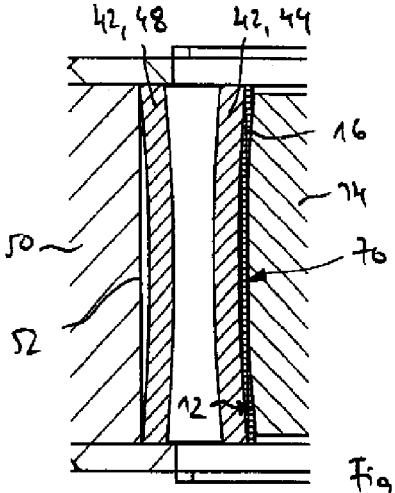
Figure 10C:
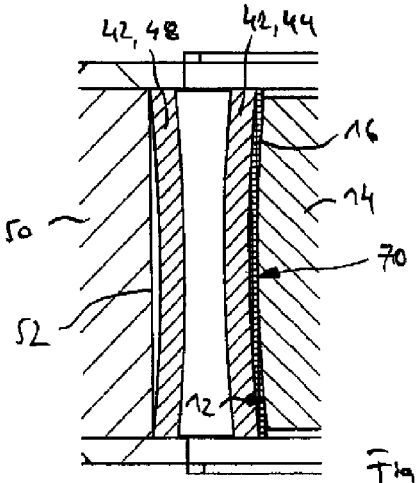

FIG. 10*c* shows a diagram corresponding to FIG. 9. FIGS. 10*b* and 10*a* show workpiece processing phases preceding the state of FIG. 10*c*.

Figure 11A:
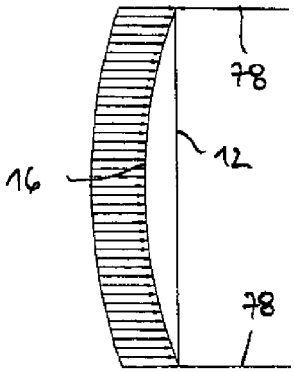
FIGS. 11*a* to 11*c* respective force profiles corresponding to the successive workpiece machining phases shown in FIGS. 10-10*c;*
Figure 11B:
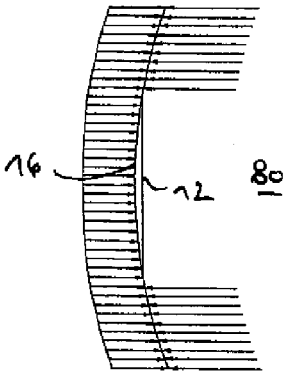

In the state shown in FIG. 10*a*, the workpiece surface 12 of the workpiece 14 is cylindrical. Due to the curvature of the effective surface 70 of the finishing belt 16, only edge regions 74 of the finishing belt 16 are initially in contact with corresponding edge regions 76 of the workpiece 14. These regions apply correspondingly high opposing forces 78 (see FIG. 11*a*) on the finishing belt 16. With progressive machining the workpiece surface 12, the opposing forces 78 move further toward a central region 80 (see FIG. 11*b*) of the workpiece 14.

Figure 11C:
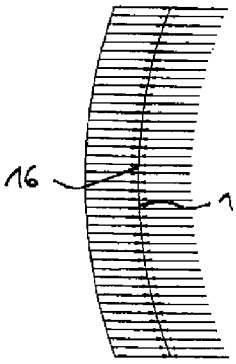

FIG. 11*c* shows a state in which the workpiece surface 12 assumes a curved nominal contour. In this state, the concave radius of curvature of the active surface 70 of the finishing belt 16 communicates with the convex radius of curvature of the workpiece surface 12 of the workpiece 14, with the working surface 70 being in full contact with the workpiece surface 12 of the workpiece 14 across the width direction 72.

Regarding the pressing devices 30 described hereinafter with reference to FIGS. 12 to 27, reference is made to the foregoing description of the pressing devices 30 illustrated in FIGS. 1 to 11*c*. Subsequently, particular differences from the above-described pressing devices 30 to be discussed.

Figure 12:
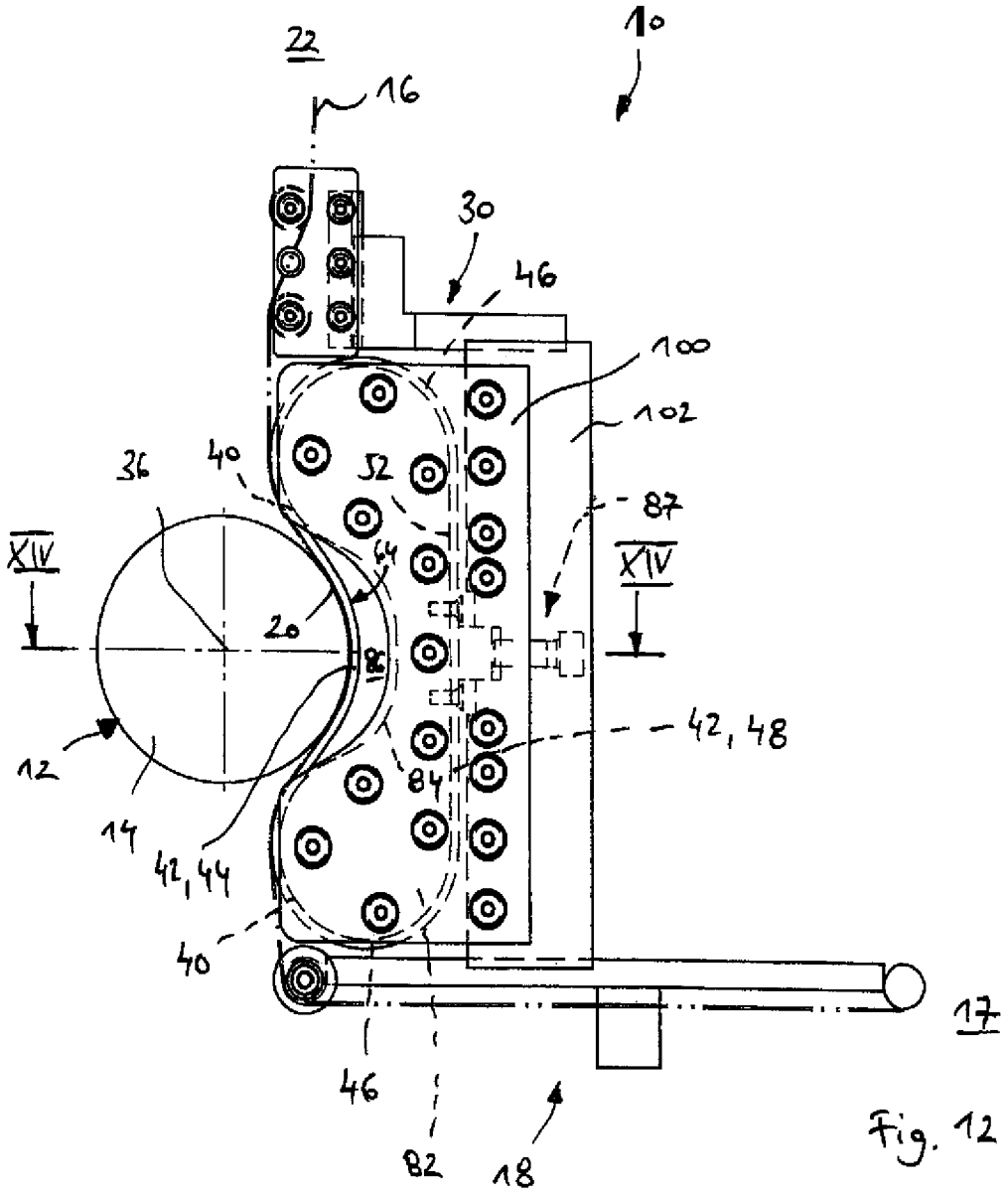
FIG. 12 a side view of another embodiment of a belt finishing device, illustrating a first workpiece having a first diameter.
Figure 13:
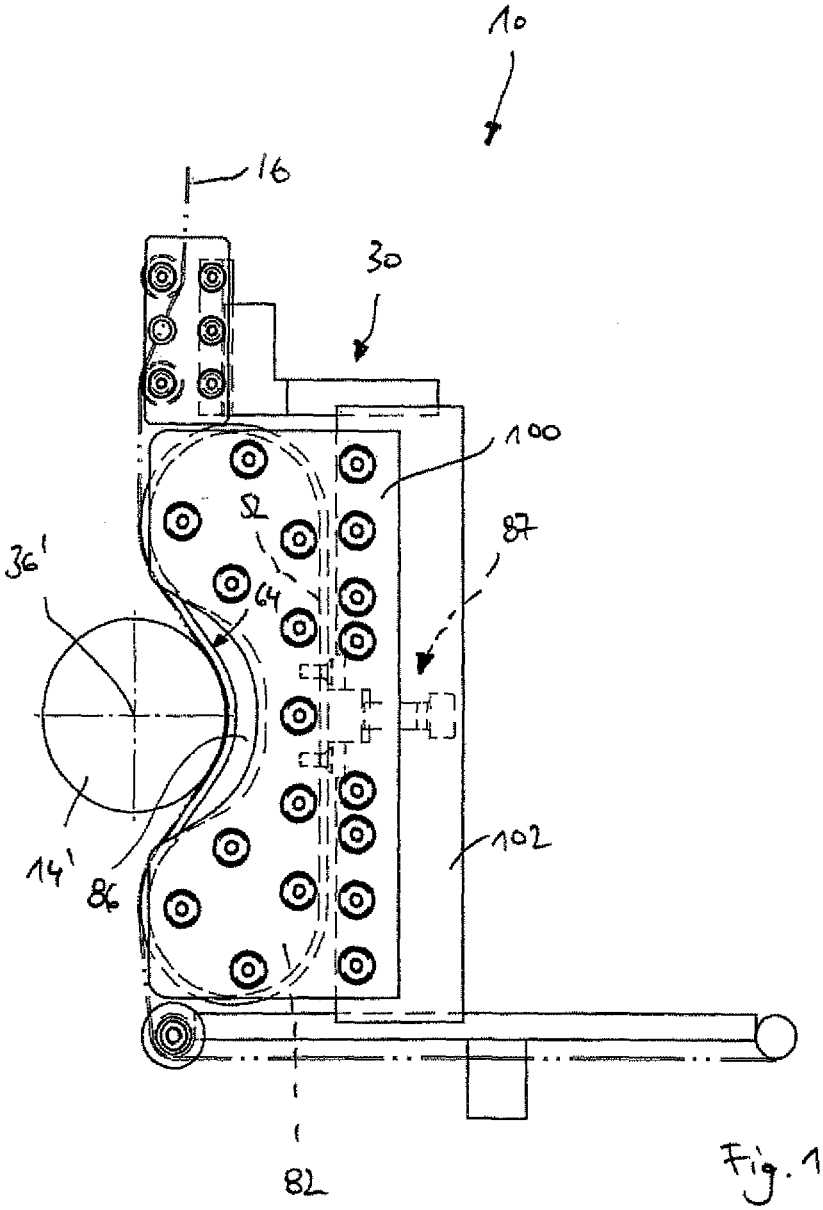
FIG. 13 a view corresponding to FIG. 12, illustrating a second workpiece with a first diameter that is smaller in comparison with the second diameter.
Figure 14:
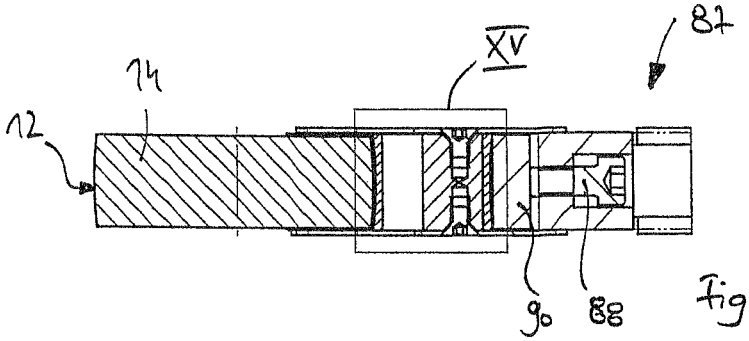
FIG. 14 a view along a section line designated in FIG. 12 with XIV-XIV.
Figure 15:
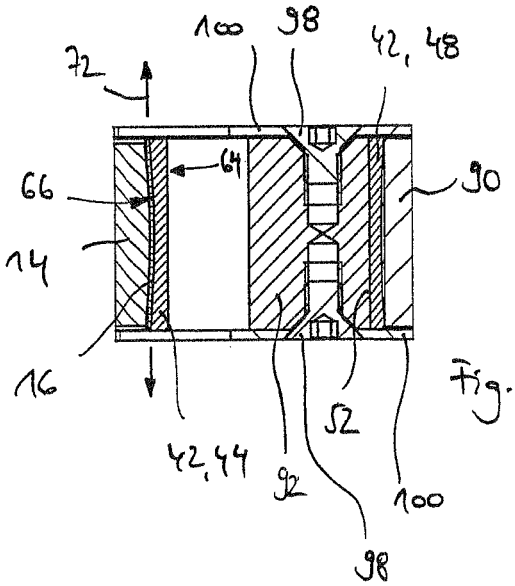
FIG. 15 an enlarged detail marked in FIG. 14 with XV.

The pressing devices 30 according to FIGS. 12 and 13 have instead of the bearing rollers 38 a stationary bearing element 82 with immovable bearing surfaces 40.

Figure 16:
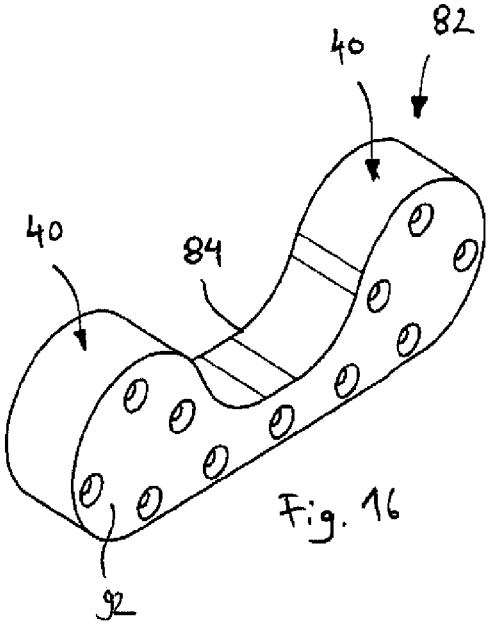
FIG. 16 a perspective view of an embodiment of a bearing element for use in the belt finishing device of FIG. 12.
Figure 17:
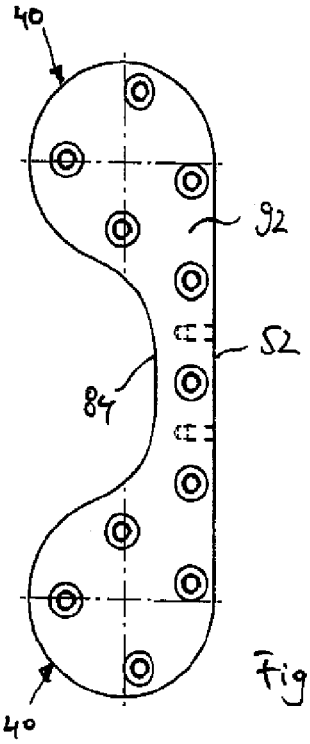
FIG. 17 a side view of the bearing element according to FIG. 16.
Figure 22:
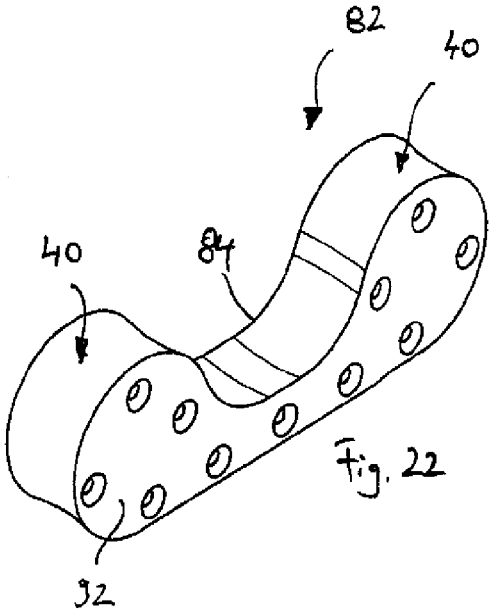
FIG. 22 a perspective view of another embodiment of a bearing element for use in the belt finishing device of FIG. 12.

These bearing elements 82 are shown, for example, in a perspective view in FIGS. 16 and 22. The bearing elements 82 have in the region between two spaced-apart bearing surfaces 40 a constriction 84 associated with the effective region 20 of the finishing belt 16. The constriction 84 is so large that the back side 64 of a front section 44 of the pressure belt 42 arranged at the level of the active section 20 of the finishing belt 16 is spaced from the bearing element 82, forming a clearance 86 (see FIGS. 12 and 13). The clearance 86 forms an escape space for the front section 44 of the pressure belt 42 when in contact with part of the periphery of the workpiece surface 12 of a workpiece 14 to be finished. Depending on the size of the workpiece 14 and of the diameter of the surface of the workpiece 12 to be machined, the profile of the pressure belt 42 adapts to the profile of the workpiece surface 12 to be machined (for example, to large workpieces 14, see FIG. 12 and to smaller workpieces 14', see FIG. 13).

The bearing elements 82 have a bearing surface 52 disposed on the side facing away from the constriction 84.

The pressing device 30 according to FIGS. 12 and 13 further includes a fixing device, generally designated with the numeral 87, for fixing the pressure belt 42 relative to the bearing surfaces 40. The fixing device 87 includes, for example, an actuating element 88 in the form of a screw that presses a fixing element 90 against the pressure belt 42, and in turn presses the pressure belt 42 against the bearing surface 52 (see FIGS. 14 and 15).

Figure 18:
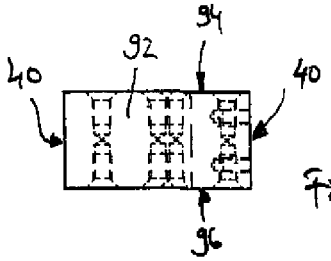
FIG. 18 a plan view of the bearing element of FIG. 16.
Figure 19:
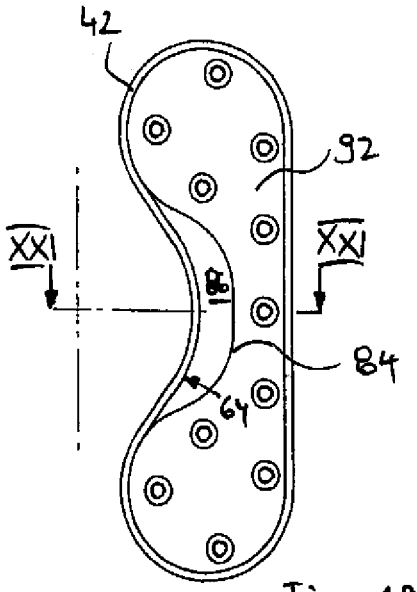
FIG. 19 a view corresponding to FIG. 17 when using a pressure belt having a curved profile.
Figure 20:
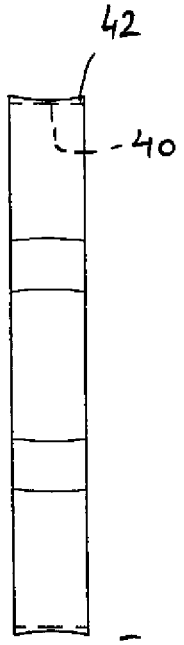
FIG. 20 a front view of the arrangement of FIG. 19.

The bearing element 82 has, for example, a one-piece bearing element 92 extending in the width direction 72 of the finishing belt 16 (see FIG. 15) between opposing side surfaces 94 and 96 (see FIG. 18).

The bearing body 92 may be connected, for example with screws 98, with mounting elements 100 (see FIGS. 15 and 12) which serve to fasten the bearing element 82 to the holders 32 (see FIG. 1). The mounting elements 100 may be connected with a frame 102 (see FIGS. 12 and 13), which is in turn connected to a holder 32.

In the embodiment of a pressing device 30 shown in FIGS. 12 to 21, the bearing surfaces 40 of the bearing element 82 have a straight course. These bearing surfaces 40 correspond to surface sections of a cylindrical envelope between their transition to the constriction 84 and to the bearing surface 52. These surface surfaces 40 serve to support a pressure belt 42 having a pressing surface 66 with a curved profile, in particular is concave profile (see FIG. 15).

The bearing surface 52 of the bearing element 82 illustrated in FIGS. 16 to 21 preferably extends in a straight plane.

In the embodiment of a bearing element 82 and a pressure belt 42 illustrated in FIGS. 12 to 15 and for use in a pressing device 30 shown in FIGS. 22 to 27, the bearing surfaces 40 have a curved profile, in particular a profile with a concave curvature. Such bearing elements 82 can be used, as shown in particular in FIGS. 25 to 27, in conjunction with a pressure belt 42, which has in an undeformed initial state a rectangular cross-section with a profiled straight pressing surface 66. When using such a pressure belt 42, the shape of curvature of the bearing surface 40 is transferred to the pressing surface 66 and to the finishing belt 16, and to the workpiece surface 12 to be machined.

Figure 21:
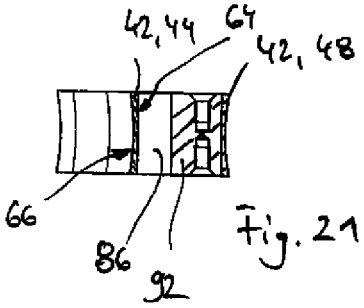
FIG. 21 a view of the arrangement of FIG. 19 along a section line designated in FIG. 19 with XXI-XXI.
Figure 23:
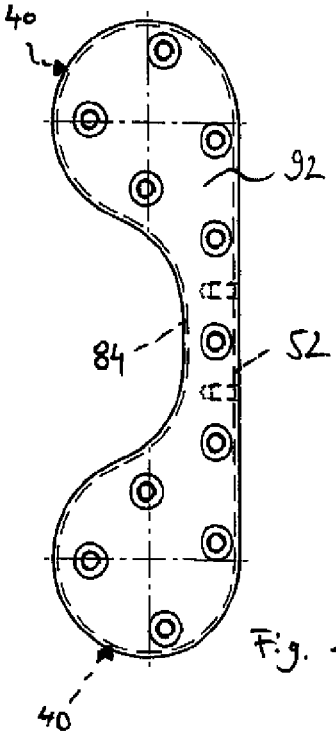
FIG. 23 a side view of the bearing element of FIG. 22.
Figure 24:
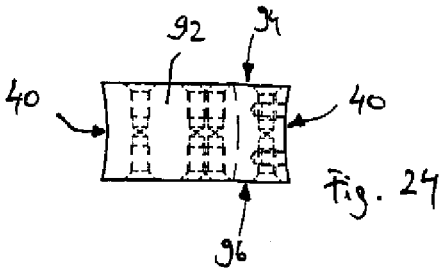
FIG. 24 a plan view of the bearing element of FIG. 22.
Figure 25:
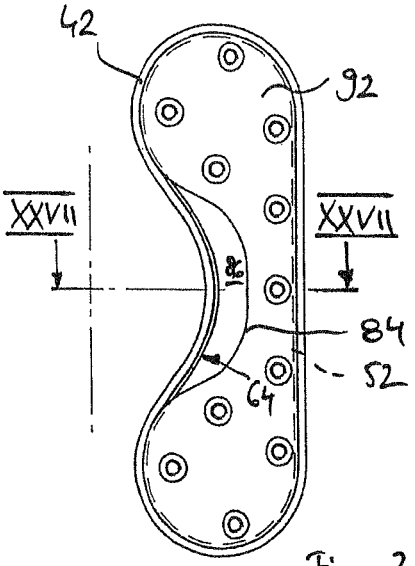
FIG. 25 a view corresponding to FIG. 23 when using a pressure belt having a straight profile in an uninstalled state.
Figure 26:
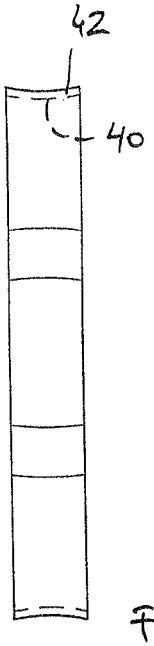
FIG. 26 a front view of the arrangement of FIG. 25.
Figure 27:
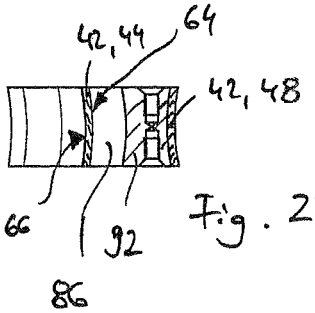
FIG. 27 a view of the arrangement of FIG. 25 along a section line designated in FIG. 25 with XXVII-XXVII.
Figure 28:
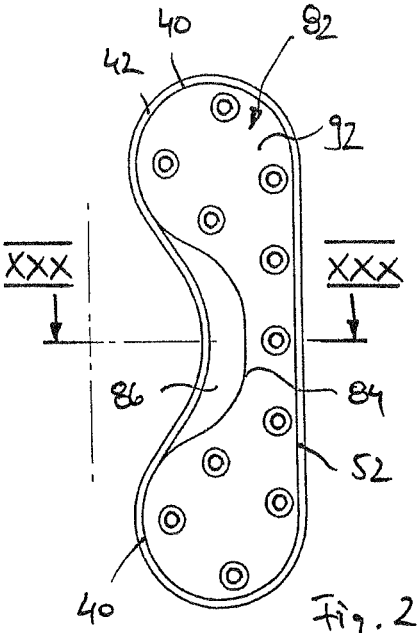
FIG. 28 a side view of another embodiment of an arrangement with a bearing element and a pressure belt.
Figure 29:
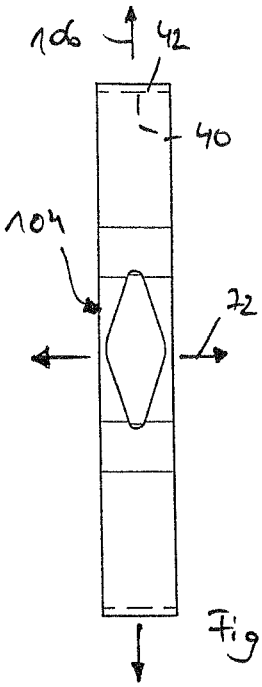
FIG. 29 a front view of the arrangement of FIG. 28.
Figure 30:
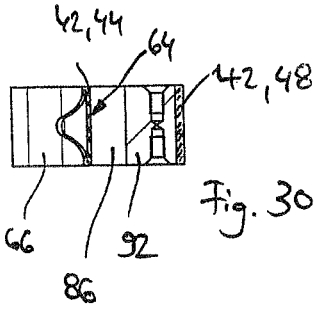
FIG. 30 a view of the arrangement of FIG. 28 along a section line designated in FIG. 28 with XXX-XXX.
Figure 31:
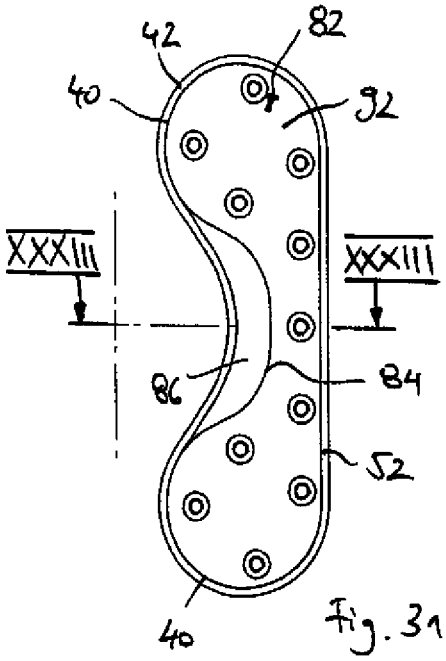
FIG. 31 a side view of another embodiment of an arrangement with a bearing element and a pressure belt.
Figure 32:
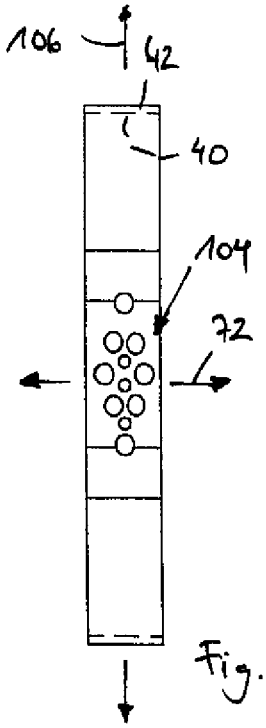
FIG. 32 a front view of the arrangement of FIG. 31.
Figure 33:
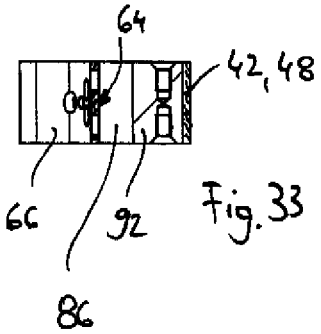
FIG. 33 a view of the arrangement of FIG. 31 along a section line designated in FIG. 31 with XXXIII-XXXIII.

However, the support element 82 according to FIGS. 22 to 24 can alternatively be used in conjunction with a pressure belt 42, which has a pressing surface 66 with a curved profile (such a pressure belt 42 is shown for example in FIG. 21).

For the embodiments described below with reference to FIGS. 28 to 33, reference is made to the above description. The pressure belts 42 according to FIGS. 28 to 33 have, in contrast to the above-described pressure belts 42, openings 104 which are arranged in particular at the height of the constriction 84 and thus at the height of the effective region 20 of the finishing belt 16. Only a single opening 104 (see FIG. 29) may be provided. Alternatively, a plurality of openings 104 may be provided (see FIG. 32).

The openings 104 extend in the width direction 72 of the finishing belt 16 as well as in the running direction 106 of the finishing belt 16.

When only a single opening 104 is provided, this opening may preferably be substantially elliptic or rhombic.

Figure 34:
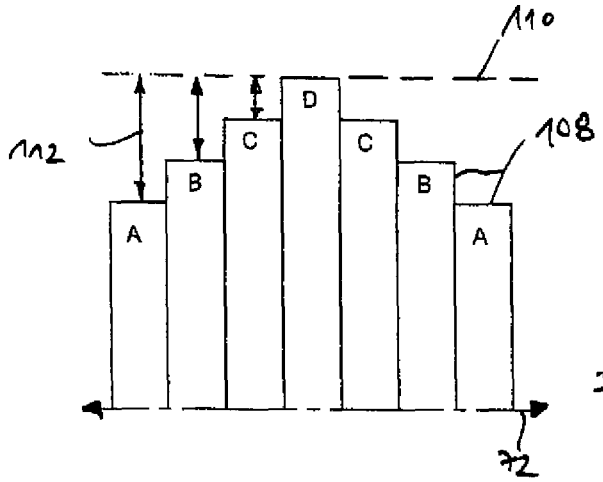
FIG. 34 a schematic view of an example of a nominal contour of a workpiece surface.

FIG. 34 shows on an enlarged scale a nominal contour 108 of a workpiece 14 which is shown across the width direction 72 of the finishing belt 16. The nominal contour 108 deviates from a circular cylindrical shape 110, namely by different quantities of removed workpiece material 112. The largest quantities of workpiece material 112 are removed from the outside nominal contour sections A, a lesser amount of workpiece material is removed from the nominal contour sections B, still smaller amounts of workpiece material are removed from the nominal contour sections C, and no or only an insignificant amount of workpiece material is removed from the nominal contour section D.

Figure 35:
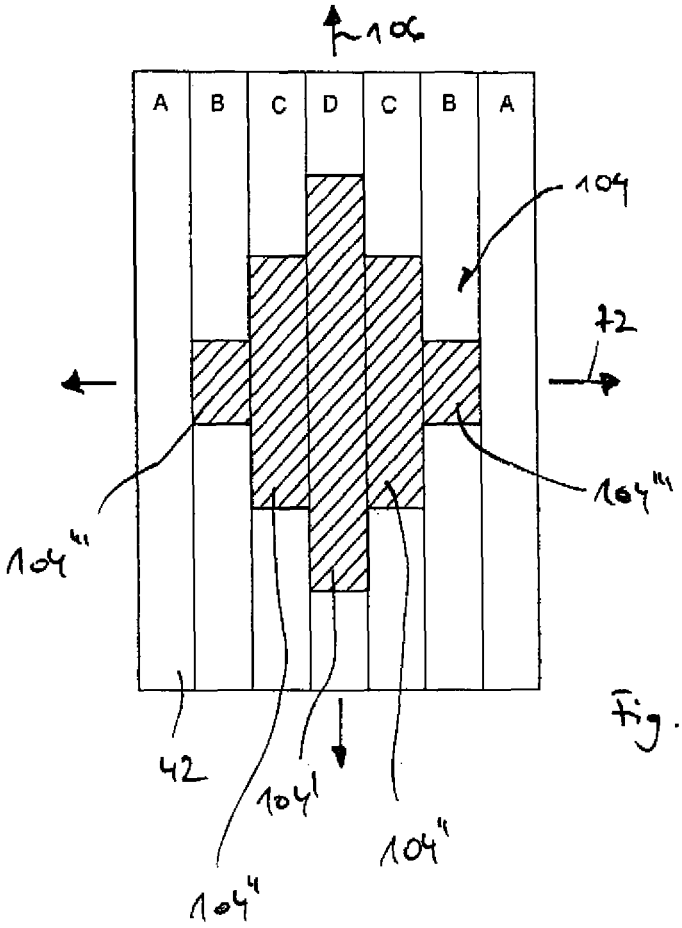
FIG. 35 a front view of an embodiment of a pressure belt for producing a nominal contour as shown in FIG. 34.

For dimensioning a discontinuity 104 shown in FIG. 35, a pressure belt 42 with successive belt sections (ABCDCBA), as viewed in the width direction 72 of the finishing belt 16, is provided. A belt section D, which cooperates with a nominal contour section D of the nominal contour 108 of the workpiece 14, has a discontinuity 104', which is longer in the running direction 106 of the finishing belt 16 than discontinuities 104" associated with belt sections C that cooperate with corresponding nominal contour sections with greater material removal rates 112. Overall, for example, an arrangement shown in FIG. 35 is obtained, wherein mutually adjacent discontinuities 104, 104', 104", 104'"together form a continuous discontinuity 104. Alternatively, the discontinuities 104, 104', 104", 104" may also be arranged separately.

Figure 36:
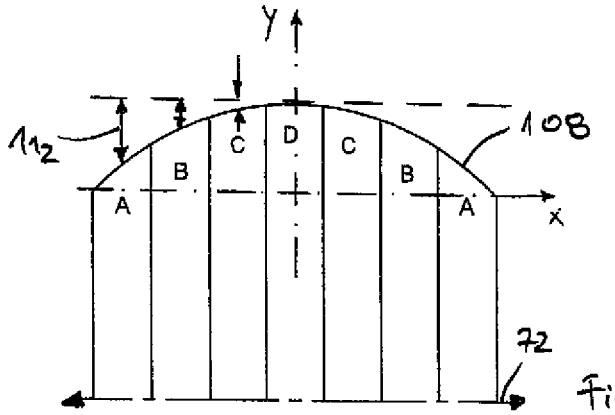
FIG. 36 a schematic view of another example of a nominal contour of a workpiece surface.

In a further refinement of the dimensions of a discontinuity 104, the nominal contour 108 of a workpiece 14 may also be described in the form of, for example, a continuous and kink-free function, as indicated in FIG. 36 by a coordinate system. For example, such a function may be a circle or a logarithmic function. Depending on the function, the course 114 of an opening 104 can then be determined (see FIG. 37).

Figure 37:
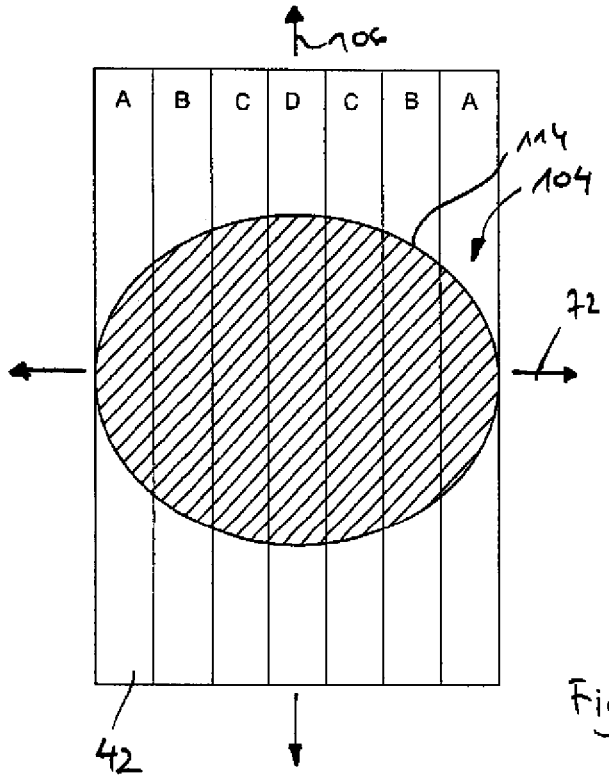
FIG. 37 a front view of an embodiment of a pressure belt for producing a nominal contour as shown in FIG. 36.

With the discontinuities 104 shown for example in FIGS. 35 and 37, different material removal rates 112 can be realized in the width direction 72 of the finishing belt 16. Because the pressure belt 42 has in the running direction 106 a longer discontinuity in a central section D, the finishing belt 16 is pressed in this region with a lower tension against the workpiece 12, resulting in a smaller quantity of removed material. Conversely, the openings are shorter in lateral belt sections (for example, in belt sections B), as viewed in the running direction 106 of the finishing belt 16, so that the pressure belt 42 is pressed against the finishing belt 16 in these belt sections with greater force, resulting in greater material removal in these areas.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A belt finishing device, comprising:

a finishing belt, two bearing surfaces that are spaced-apart in a running direction of the finishing belt, and a pressing device for pressing the finishing belt against a workpiece surface, wherein the pressing device comprises a pressure belt that is supported on the two spaced-apart bearing surfaces, wherein at least one of the two bearing surfaces and the pressure belt have a profile that deviates in a width direction of the finishing belt from a straight course, wherein at least one bearing of the two bearing surfaces or the pressure belt, or both, have at least one discontinuity in the form of a pocket-shaped recess or an opening.

2. The belt finishing device of claim 1, wherein the profile is curved.

3. The belt finishing device of claim 1, wherein at least one of the bearing surfaces comprises a bearing roller.

4. The belt finishing device of claim 3, wherein the bearing roller is floatingly supported.

5. The belt finishing device of claim 3, further comprising a stationary bearing roller support device supporting the bearing roller.

6. The belt finishing device of claim 1, wherein at least one of the bearing surfaces is formed by a stationary bearing element.

7. The belt finishing device of claim 1, further comprising a fixing device for fixing the pressure belt relative to the bearing surfaces.

8. The belt finishing device of claim 1, wherein the profile is disposed on a pressing surface of pressure belt facing the finishing belt.

9. The belt finishing device of claim 1, wherein the pressure belt is shaped as an endless belt.

10. The belt finishing device of claim 9, further comprising a pressure belt support device supporting a rearward section of the pressure belt, wherein the rearward section is spaced from the finishing belt and extends between the two spaced-apart bearing surfaces.

11. A belt finishing system, comprising:

a belt finishing device having a finishing belt, two bearing surfaces that are spaced-apart in a running direction of the finishing belt, and a pressing device for pressing the finishing belt against a workpiece surface, wherein the pressing device comprises a pressure belt that is supported on the two spaced-apart bearing surfaces, wherein at least one of the bearing surfaces or the pressure belt, or at least one of the bearing surfaces and the pressure belt, has a profile that deviates in a width direction of the finishing belt from a straight course, and a workpiece having a workpiece surface to be finish-processed, wherein the workpiece surface is interrupted in a region of a bore, wherein at least one of the two bearing surfaces and the pressure belt have at least one discontinuity, and wherein a position of the discontinuity in the width direction of the finishing belt matches to a position of the bore.

12. A method for producing a belt finishing device having a finishing belt, two bearing surfaces that are spaced-apart in a running direction of the finishing belt, and a pressing device for pressing the finishing belt against a workpiece surface, wherein the pressing device comprises a pressure belt that is supported on the two spaced-apart bearing surfaces, wherein at least one of the two bearing surfaces and the pressure belt have a profile that deviates in a width direction of the finishing belt from a straight course, the method comprising:

determining a nominal contour of a finish-machined workpiece surface, and performing additionally at least one of the following steps:

providing at least one of the two bearing surfaces or a pressing surface of the pressure belt facing the finishing belt with a profile that is more pronounced than the nominal contour;

providing each of at least one of the two bearing surfaces and a pressing surface of the pressure belt facing the finishing belt with a corresponding partial profile, wherein a superposition of the partial profiles is identical to the nominal contour;

defining first nominal contour sections and determining for each of the first nominal contour sections a removal of material from the workpiece that is different from a circular cylindrical shape; providing at least one of a bearing surface and the pressure belt with at least one discontinuity, wherein the at least one discontinuity is associated with a first nominal contour section having a lesser quantity of material removed from the workpiece than an adjacent nominal contour section;

defining second nominal contour sections, and determining for each of the second nominal contour sections a removal of material from the workpiece that is different from a circular cylindrical shape; providing at least one of the two bearing surfaces and the pressure belt with discontinuities, with each discontinuity being associated with a corresponding second nominal contour section, wherein the discontinuities have different lengths as measured in a running direction of the finishing belt, and wherein discontinuities having shorter lengths are associated with the second nominal contour sections having greater material removal rates and discontinuities having greater lengths are associated with the first nominal contour sections having lower material removal rates.

13. The method of claim 12, wherein the profile or the superposition of the partial profiles have a contour that is more pronounced than the nominal contour, and wherein the profile or the superposition of the partial profiles delimits a segment of a circle, as viewed across an effective width of the finishing belt, with a segment height being greater by a factor from 1.5 to 25 than a segment height of a segment of a circle that is delimited by the nominal contour, as viewed across the effective width of the finishing belt.

14. The method of claim 13, wherein the segment height is greater by a factor from 3 to 15.

15. The method of claim 13, wherein the segment height is greater by a factor from 5 to 10.

16. A belt finishing device for finish-processing a workpiece, comprising:

a workpiece having a workpiece surface to be finish-processed, a finishing belt, two bearing surfaces that are spaced-apart in a running direction of the finishing belt, and a pressing device for pressing the finishing belt against the workpiece surface, wherein the pressing device comprises a pressure belt that is supported on the two spaced-apart bearing surfaces, wherein at least one of the two bearing surfaces and the pressure belt have a profile that deviates in a width direction of the finishing belt from a straight course, wherein the workpiece is during finish-machining rotated about a workpiece axis and an oscillating relative movement of the workpiece parallel to the workpiece axis is superimposed on the rotation of the workpiece, such that the workpiece surface is provided with a cross-cut structure characteristic for finishing method.

17. A belt finishing device for finish-processing a workpiece, comprising:

a finishing belt, two bearing surfaces that are spaced-apart in a running direction of the finishing belt, and a pressing device for pressing the finishing belt against a workpiece surface, wherein the pressing device comprises a pressure belt that is supported on the two spaced-apart bearing surfaces, wherein at least one of the two bearing surfaces, or the pressure belt, or both have a profile that deviates in a width direction of the finishing belt from a straight course, wherein the bearing surfaces are immovable and formed by a stationary bearing element.

* * * * *